United States Patent [19]

Getz et al.

[11] 4,384,378

[45] May 24, 1983

[54] MOBILE BODY LIFT

[75] Inventors: Clarence A. Getz, Helena, Mont.; Clair A. Bearfield, Valley City, N. Dak.

[73] Assignee: Tri W-G, Inc., Valley City, N. Dak.

[21] Appl. No.: 198,164

[22] Filed: Oct. 17, 1980

[51] Int. Cl.[3] ..... A61G 7/10

[52] U.S. Cl. ..... 5/86; 5/81 B

[58] Field of Search ..... 5/61, 62, 63, 83, 86, 5/81 B

[56] References Cited

U.S. PATENT DOCUMENTS

| | | | |
|---|---|---|---|
| 2,603,851 | 7/1952 | Hawkins | 5/85 |
| 2,828,172 | 3/1958 | McDonald . | |
| 3,049,726 | 8/1962 | Getz | 5/86 |
| 3,609,779 | 10/1971 | Oja et al. | 5/62 |
| 3,640,520 | 2/1972 | Wieland et al. | 269/323 |
| 3,806,109 | 4/1974 | Weber et al. | 269/323 |
| 3,877,089 | 4/1975 | Spivey et al. | 5/86 |
| 4,021,028 | 5/1977 | Weber et al. | 269/325 |
| 4,059,255 | 11/1977 | Perold | 269/323 |

FOREIGN PATENT DOCUMENTS

| | | | |
|---|---|---|---|
| 382620 | 2/1908 | France | 5/61 |

*Primary Examiner*—Alexander Grosz

*Attorney, Agent, or Firm*—Schroeder, Siegfried, Vidas, Steffey & Arrett

[57] ABSTRACT

A mobile body lift comprising an inverted U-shaped lift frame moved vertically relative to a supporting mobile frame by mechanical actuator mechanism and having a T-shaped support at its foot end and a U-shaped support at its head end, each of which are pivotally connected at their upper ends to opposite ends of a pair of spaced parallel horizontal support bars, and a pair of bed frame suspensions, each of which is pivotally connected at its upper end to one of said horizontal bars and each of which is pivotally connected at its lower end to a bed frame.

18 Claims, 10 Drawing Figures

Fig. 1
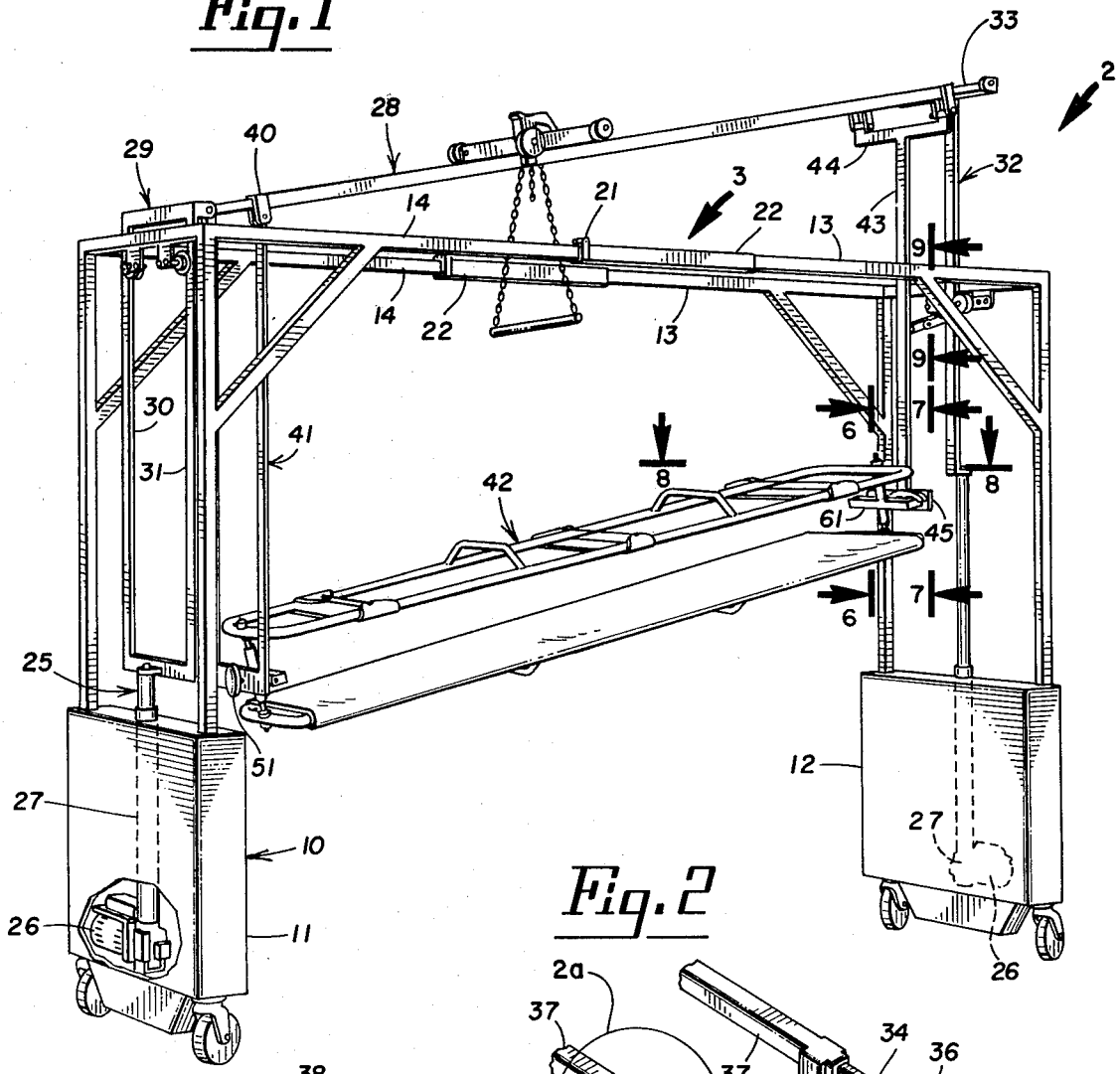
Fig. 2
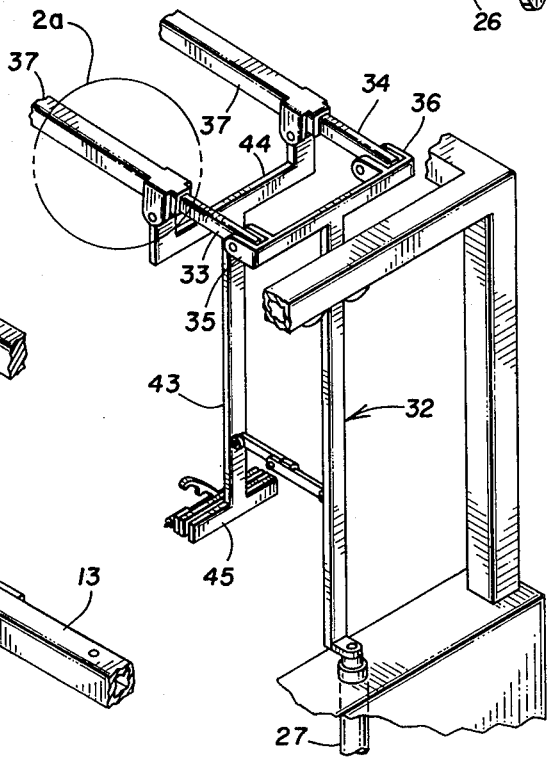
Fig. 2a
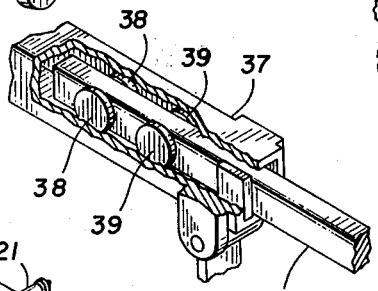
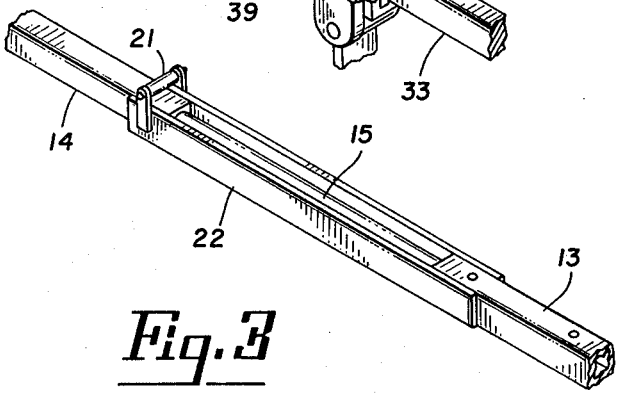
Fig. 3

17
13
23
16
15
22
20
24
18
21
19
14

13
23
16
20
24
21
19
14

43
51
50
45
46
47
63
66
65
42
64
61

8
8
43
52
63
56
58
60
54
46
53
59
57
55
62

MOBILE BODY LIFT

DESCRIPTION

1. Background of Prior Art

Mobile body lifts designed for use in hospitals are in common use for the purpose of moving or manipulating patients or in connection with a patient under traction. Illustrative of such vehicles is shown in U.S. Pat. No. 3,049,726 and other patents cited thereagainst. Such devices, however, require that the patient remain horizontal and the extent of their rotation about an axis extending longitudinally of the vehicle has been limited. Also, such vehicles are generally of such length that they frequently cannot conveniently pass through doorways or be transported within an elevator. Moreover, there is a definite need in such a mobile body lift for apparatus which will permit the patients body to be inclined so as to minimize lung congestion. In addition, most such vehicles unduly interfere with the various traction devices which are applied to the patient. Our invention is directed to obviating these disadvantages.

2. Brief Summary of the Invention

Disclosed is a mobile main frame having electric actuators at each end which elevate and lower a lift frame having a vertically extending rectangular support at the head end and an upright T-shaped support at the foot of the bed, the supports being pivotally connected to each end of a pair of longitudinally telescoping horizontal support bars. The main frame is also longitudinally telescoping. A U-shaped suspension bar is pivotally connected to the two parallel supports bars adjacent the head end and a T-shaped support bar is pivotally connected to the same bars adjacent the foot end. Each of the suspension bars, at its lower end mounts a bed connector mechanism for rotation throughout a 360° arc about an axis extending longitudinally of the frames. Each bed connector mechanism is comprised of a pair of transversely extending spaced sleeves fixedly mounted on the end of the bed frame and a pair of interlocking pins shiftably for movement between telescoping and non-telescoping positions relative to the sleeves on the bed. Locking means to lock the bed frame at either end of a 180° arc of rotation is provided.

It is a general object of our invention to provide a novel mobile body lift of simple but effective construction which will obviate or substantially alleviate the disadvantages outlined hereinabove.

More particularly, it is an object of our invention to provide a mobile body lift which will permit the patient to be suspended at an incline of about 12° and to be rotated throughout an arc of 360°, if desired.

A further object is to provide a mobile body lift which is longitudinally extensible or contractible.

A further object is to provide a mobile body lift which permits quick, ready and simple attachment or detachment of the bed-frame.

A still further object is to provide a mobile body lift which minimizes interference with the traction devices which are frequently needed for the patient.

These and other objects will be apparent from a study of the specifications and drawings.

BRIEF DESCRIPTION OF THE DRAWINGS

FIG. 1 is a perspective view of our mobile lift with the foot of the bed frame elevated;

FIG. 2 is a fragmentary perspective view on an enlarged scale of the foot end portion of the frame and bed suspension;

FIG. 2*a* is a detailed fragmentary perspective view with portions broken away, and on a further enlarged scale, of telescoping portions of the lift frame shown within the circle 2*a* of FIG. 1;

FIG. 3 is a partial perspective view on an enlarged scale of a telescoping section of the main frame, as viewed from position 3 identified in FIG. 1;

DETAILED DESCRIPTION OF THE INVENTION

Figure 4:
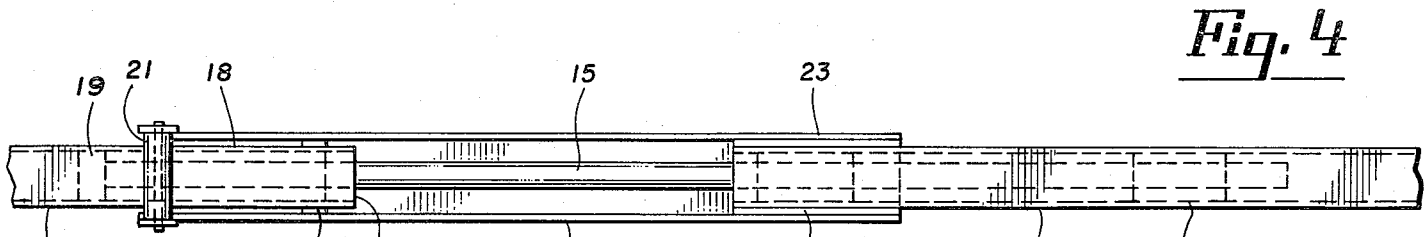
FIG. 4 is a partial plan view on a further enlarged scale of the main frame section shown in FIG. 3.
Figure 5:
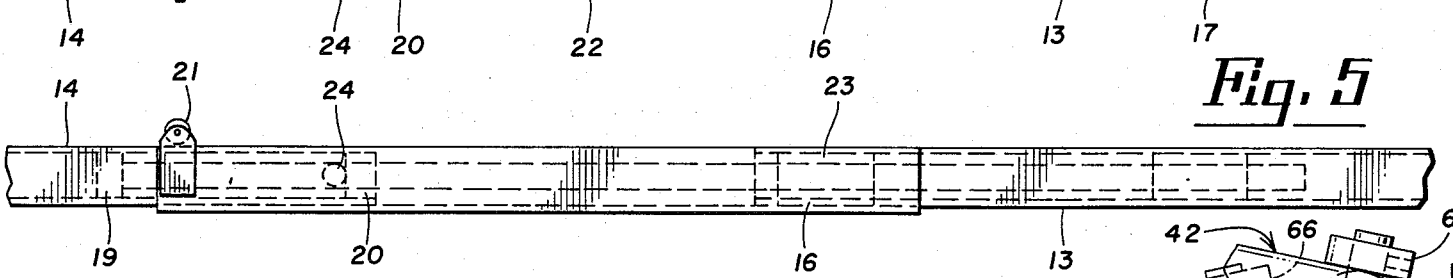
FIG. 5 is a partial side elevational view on a further enlarged scale of the main frame section shown in FIG. 3.

One embodiment of our invention may include as shown in FIGS. 1–8 inclusive, a wheeled rigid main frame 10 having opposite end portions 11, 12 connected by rigid horiziontal support tubes 13, 14, each of which are longitudinally extensible and contractable. As best shown in FIGS. 4 and 5, each of the tubes 13 and 14 is connected by an open section which expand by a travel rod 15 which is fixedly mounted within bearing 16, 17, each of which is fixedly secured to the interior of the tube 13. The opposite end of the rod 15 is fixedly mounted within a piston-like tube 18 which has end blocks 19, 20 secured as by welding therein. The tube 18 slides within the opposite portion of the support tubes 14 and is guided by a roller 21 which is pivotally mounted across the upper side of the tube 14 and across one end of the interconnecting channel member 22 which is fixedly secured to the opposite end of the travel rod as at 23. Nylon guide buttons 24 aid in guiding the piston like tube 18 in its travel as the main frame is extended or contracted as desired.

Each of the end portions 11, 12 of the main frame 10 carries a powered actuator indicated generally by the numeral 25. Each such actuator includes an electric motor 26 which drives a ball bearing screw 27 which can be obtained from the Saginaw Steering Gear Division of General Motors Corporation. Each of the motors 26 is provided with a separate switch (not shown) which permits each of the motors to be operated either separately or simultaneously in the same or in opposite directions so that the lift frame indicated generally as 28, which is supported thereby may have one end elevated while the other is being lowered and vice versa.

The lift frame 28 includes a rigid rectangular frame indicated generally as 29 which is mounted upon the upper end of the ball bearing screw 27 at the head end of the main frame. The rectangular frame 29 includes a pair of vertical support arms 30, 31. The ball bearing screw 27 at the opposite or foot end of the main frame supports a T-shaped support 32, as best shown in FIG. 2. At the outer ends of the T-shaped support 32 a pair of support bars 33, 34 which are rectangular in cross section are pivotally connected as at 35, 36. These support bars 33, 34 are longitudinally extensible and contractable in that each includes an elongated tube which is rectangular in cross section and which will receive at each of its ends a bar similar in construction to the bar 33 and 34. Thus, at the opposite end of the tube 37 from that shown in FIG. 2*a*, there are similar bars which are pivotally connected to the upper corners of the rectangular frame 29 at the upper ends of the support arms 30, 31. Each of these bars, 33, 34, extends into the hollow interior of the bar 37 and carries a pair of nylon rollers 38, 39 at its opposite sides to facilitate sliding movement therebetween. Thus, it can be seen that both the main frame and the lift frame 28 are longitudinally extensible and contractable as desired.

Pivotally suspended from the lift frame 28 at the head end of the main frame as at 40 is a U-shaped bed frame suspension 41. This suspension 41 is pivotally connected at its upper ends to the support bars 33, 34 and is connected to the bed frame indicated generally as 42, as will be hereinafter described with respect to the opposite end portion of the lift frame.

Figure 7:
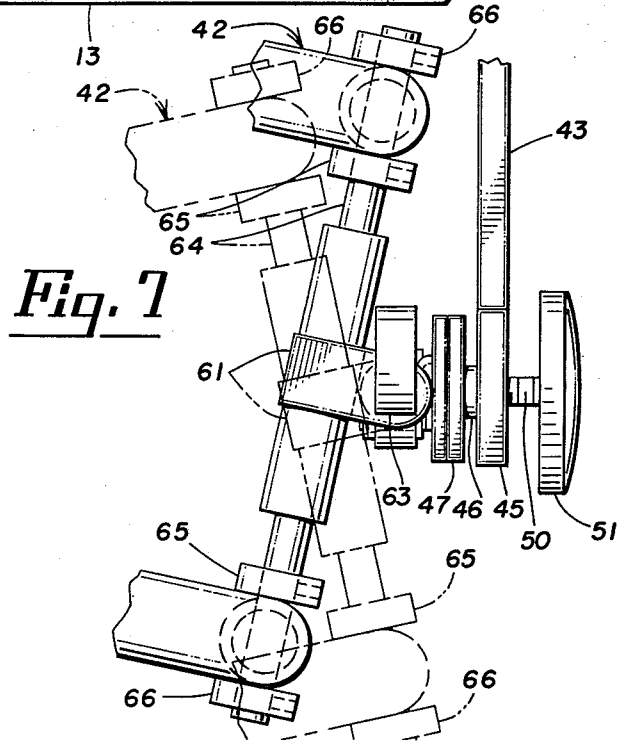
FIG. 7 is a partial side elevational view on an enlarged scale taken along line 7—7 of FIG. 1.
Figure 6:
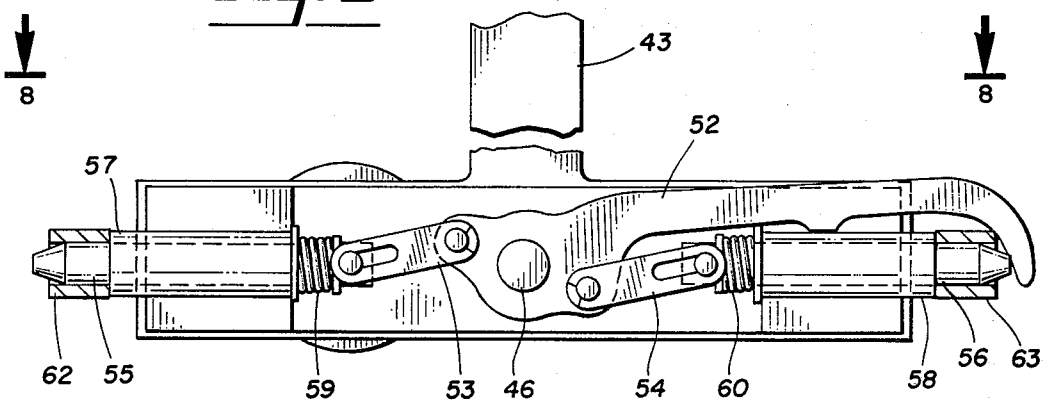
FIG. 6 is a partial sectional view on an enlarged scale of the bed frame connector taken along line 6—6 of FIG. 1.
Figure 8:
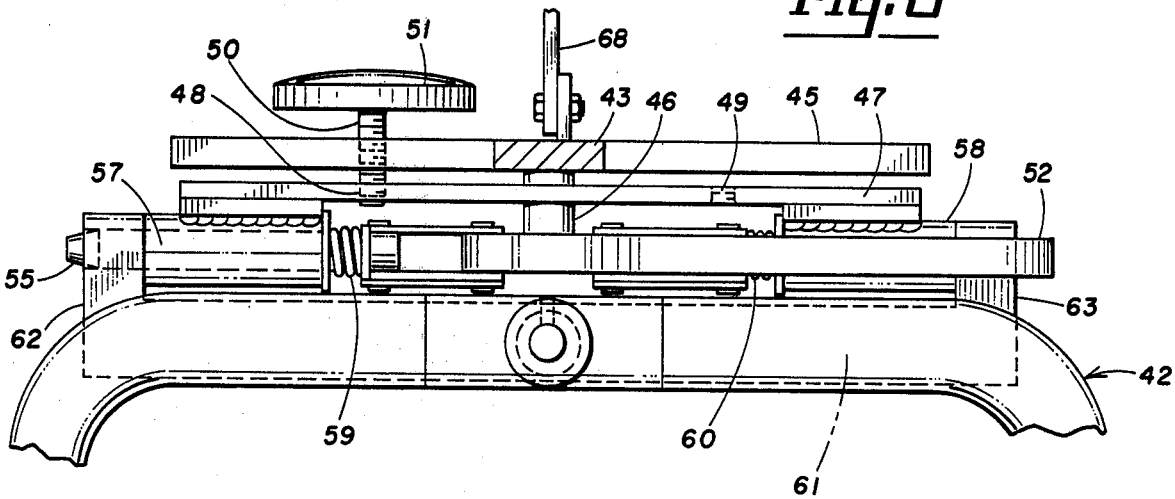
FIG. 8 is a partial top plan view on an enlarged scale taken along line 8—8; and, FIG. 9 is a side elevational view on an enlarged scale of the frame stablizing lock in locked position.

At the opposite end portion of the lift frame 28, a T-shaped bed frame suspension 43 is pivotally connected to the tubes 37 at each of the outer ends of its top cross car 44. This can best be seen by reference to FIG. 2. The lower end of the T-shaped bed frame suspension 43 carries a cross bar 45 which mounts a bed connector mechanism as shown in FIGS. 6–8 inclusive. As shown in FIG. 8, the cross bar 45 supports a pivot shaft 46 which extends inwardly toward the opposite end of the main frame. Pivotally mounted on the shaft 46 for 360° rotation with respect thereto is a pivot bar 47 which has a pair of threaded openings 48, 49 extending therethrough either of which may threadedly receive a threaded locking bolt 50 which carries a turning knob 51 at its outer end. Thus the pivot bar 47 is free to swing throughout a 360° arc and may be fixed at either end of a 180° arc by threading the locking pin 50 in either of the opening 48, 49.

It will be noted that the pivot shaft 46 extends inwardly and supports a pivoting latching arm 52. This latching arm has a pair of links 53, 54 pivotally mounted thereon on opposite sides of the pivot shaft 46 upon which it is pivotally mounted for swinging movement thereabouts. Each of the links 53 and 54 carries a slidable pin such as 55, 56 at its outer end and causes the latter to shift longitudinally within tubes 57, 58 respectively that are fixedly mounted upon opposite end portions of the pivot bar 47 as best seen in FIG. 8. Springs 59, 60 urge these pins inwardly at all times and it is only when arm 52 is swung to the position shown in FIG. 6 that the pins are extended outwardly into locking position with respect to a locking bar carried by bed frame 42 as will be hereinafter described.

As indicated above, a connector mechanism essentially the same as that described herein with respect to numerals 45–50, inclusive, is also fixedly connected to the lower end of the rectangular support 41, the threaded locking pin corresponding to pin 50 extending through the bar which comprises the lower side of said rectangular frame 41. Each of these connector mechanisms is adapted to cooperate with essentially identical connector means which is carried by opposite end portions of the bed frame 42. Each of these connector means includes a U-shaped bar 61 which has perforated end portions 62–63 that extend outwardly to receive therein the locking pins 55, 56, respectively. This can best be seen by reference to FIG. 8 and FIG. 6. The length of the bar 61 is such that the pins 55, 56 when retracted, can be moved to a position between the perforated end portions 62, 63 and immediately adjacent thereto so that when the lever 52 is moved to the over-dead-center position shown in FIG. 6, the pins will extend into the perforated end portions 62 and 63, as shown in FIG. 6 and FIG. 8. The perforated end portions 62 and 63 are in essence sleeves which receive the locking pins in locking relation.

The bar 61 is perforated at its mid-point for mounting of the same upon either end of the bed frame 42. Such mounting is accomplished through the use of a threaded mounting bolt 64 which extends therethrough in threaded relation. As best shown in FIG. 7, a lock-nut 65 is positioned inwardly of the bed frame 42 and a second lock-nut 66 is positioned immediately outwardly thereof so as to hold the bed frame in desired position. A similar arrangement is utilized at the opposite end of the mounting bolt 64 to hold a cooperating frame when two such frames are utilized to effect turning of the patient in a manner well known in the art. As indicated, such a mounting for a bar 61 is provided at each end of the bed frame 42.

Figure 9:
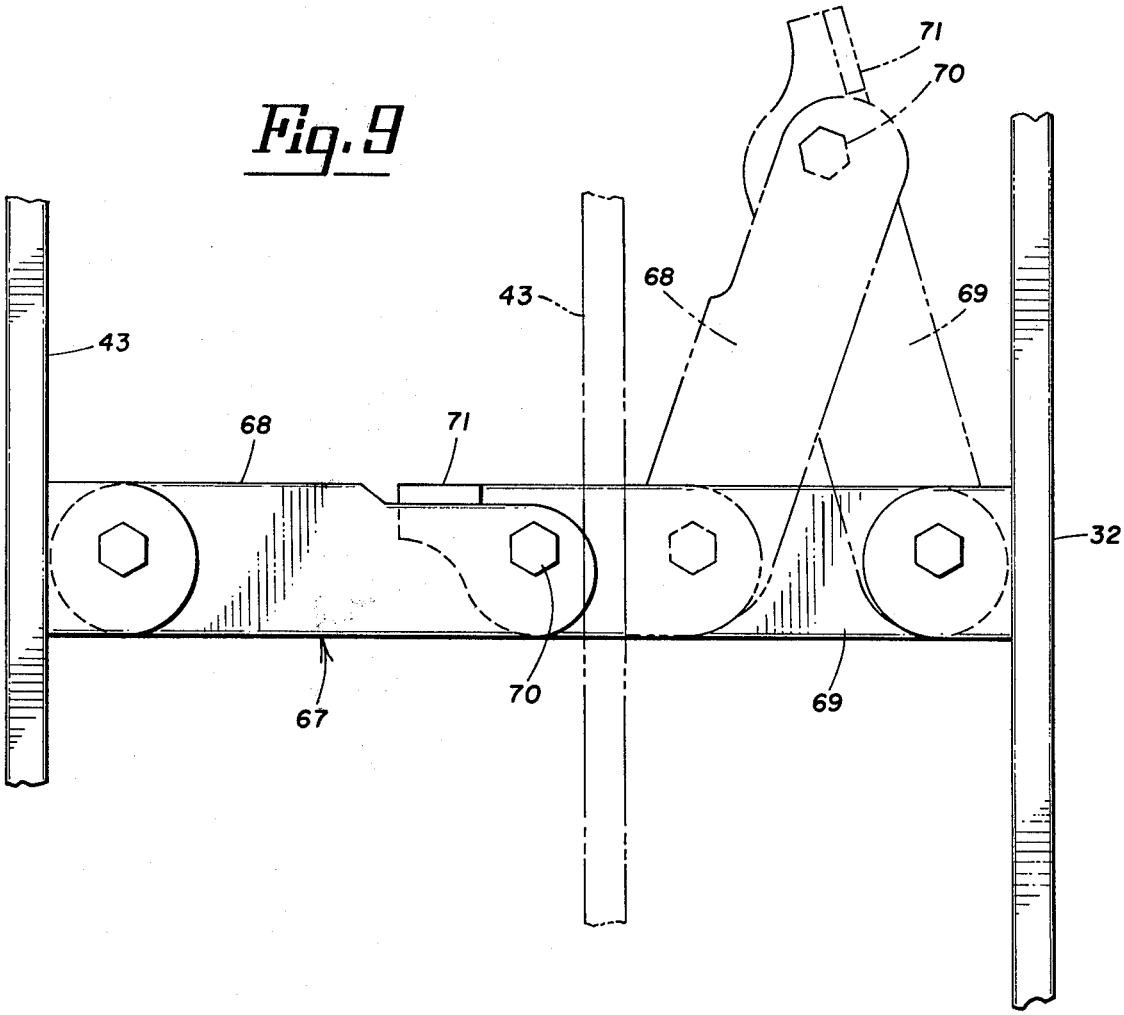

In order to stabilize the lift frame 28 with respect to the main frame, a rigid locking mechanism indicated generally at 67, is fixedly mounted upon the vertical leg of the T-shaped support 32 and the corresponding leg of the T-shaped bed suspension 43, as best shown in FIGS. 2 and 9. This locking mechanism 67 consists of a link 68 which is pivotally mounted upon the vertical leg 43 of the T-shaped bed suspension and a link 69 which is similarly pivotally mounted upon the vertical leg of the T-shaped support 32. These two links are interconnected by a bolt 70 and the link 69 is provided with a laterally extending abutment 71 so that when the links are moved to parallel opposed positions, they lock in rigid non-pivoting relation to provide a rigid brace between the two vertical elements 32 and 43.

From the above, it can be seen that our body lift provides definite advantages over those heretofore known. The connector mechanism which is carried at the lower end of the suspension means provides for ready attachment or detachment of a bed frame, such as indicated by the numeral 42. All that is required is that the lever 52 be moved to pin retracting position at which it is possible to move such pins to or from a position in which they are disposed between the sleeves 62 and 63. When the frame is so connected by these pins, it will be seen that the bed frame may be rotated throughout a 360° arc if desired and can be secured by means of the locking pin 50 at either end of the 180° arc so that the patient may be maintained in a downward facing position, or in an upwardly facing position, as desired. Moreover, it is possible, as shown in FIG. 1, to maintain the patient in an inclined position with the head either lowered or elevated relative to the patient's feet. FIG. 1 shows the foot portion of the lift in elevated position which is desirable at times. More importantly, however, the head end which is supported by the U-shaped bed frame suspension 41 can be elevated to at least a 12° incline, thereby substantially reducing the tendency for lung congestion in bed-ridden patients. Also, it is possible by simultaneously operating the motors 26 in opposite directions to produce an oscillation of the patient's body about a transverse axis extending through the longitudinal center of the bed frame, thereby inducing circulation within the patient's body.

Such induced circulation is considered highly desirable for certain patients.

If it is desired to move the mobile lift into and out of a narrow hallway and through a doorway, or if it is desired to move the same between levels of a hospital by means of an elevator not of unusual size, this can be accomplished by contracting the longitudinal dimensions of both frames, causing the arms 34 to telescope within the tubes 37 and the travel rod 15 to move inwardly to its furthermost telescoped position. In this manner, the mobile lift may be transported much more readily which increases its effective use. Of course, before telescoping the main and lift frames, the bed frame 42 is removed by releasing the connector mechanism at each end thereof by merely lifting the pivot levers 52 and thereby causing the pins 55 and 56 at each end to retract.

It will be noted that it is also possible to rotate the patient as desired while the patient is inclined. This is frequently highly desirable. It will also be noted that our mobile lift provides a minimum of interference with traction devices as a result of the use of a T-shaped suspension means at the foot of the lift. Moreover, our lift is adaptable to beds of different sizes in that it can be extended to a length exceeding that of beds of even unusual lengths.

In considering this invention, it should be remembered that the present disclosure is illustrative only and the scope of the invention should be determined by the appended claims.

We claim:

1. A body lift comprising:

(a) a mobile main frame having head and foot end portions;

(b) a lift frame carried by said main frame and being movable vertically relative thereto;

(c) controllably powered actuator mechanism carried by each of said end portions and connected to said lift frame for controllably raising and lowering the same as desired;

(d) said lift frame being comprised of a generally inverted U-shaped frame having a head end which includes a pair of transversely spaced support arms carried by said actuator mechanism at the head end portion of said main frame and supported thereby;

(e) said lift frame having a T-shaped support carried by said actuator mechanism at the foot end portion on said main frame and supported thereby;

(f) said lift frame including a pair of elongated transversely spaced, parallel, generally horizontal support bars each extending between one end portion of said U-shaped frame and said T-shaped support and being pivotally mounted thereon at each of their end portions for pivotal movement about an axis extending transversely of said horizontal bars; and (g) a pair of bed frame suspensions, one each of which is pivotally mounted upon said support bars at opposite end portions thereof for movement about an axis transverse thereof, said suspensions each including means for connecting a bed frame thereto in supporting relation.

2. A structure defined in claim 1 wherein said main frame and said lift frame are each longitudinally contractible and extensible, and said bed frame connecting means is detachable from the bed.

3. The structure defined in claim 1 wherein said support arms of said lift frame are a part of an upright rectangular frame carried by one of said powered actuator mechanisms and said rectangular frame is pivotally connected to said one of said parallel support bars at each of its upper corners.

4. The structure defined in claim 1 wherein said bed frame suspensions are each pivotally supported by said support bars.

5. The structure defined in claim 1 wherein said bed frame suspension at the head end portion of said main frame is U-shaped in configuration and is pivotally connected at the upper end of each of its legs to one of said support bars.

6. The structure defined in claim 1 wherein said bed frame suspension at the foot end portion of said main frame is generally T-shaped and is pivotally connected at its upper end to each of said support bars.

7. The structure defined in claim 6 and position locking linkage extending between said powered actuator mechanism and said bed frame suspension adjacent said foot end portion of said main frame.

8. The structure defined in claim 1 wherein each of said bed frame suspensions carries a 360° rotatable bed connector at its lower end.

9. The structure defined in claim 1 wherein each of said bed suspensions carries a readily attachable and detachable bed connector capable of pivoting throughout a 360° arc.

10. A body lift comprising:

(a) a mobile main frame having head and foot end portions;

(b) a lift frame carried by said main frame and being movable vertically relative thereto;

(c) controllable powered actuator mechanism carried by each of said end portions and connected to said lift frame for controllably raising and lowering the same as desired;

(d) said lift frame including (1) a generally inverted U-shaped frame having a head end portion carried by said actuator mechanism at the head end portion of said main frame and supported thereby; (2) a foot end portion carried by said actuator mechanism at the foot end portion of said main frame and supported thereby; (3) a pair of elongated transversely spaced, parallel, generally horizontal support bars each extending between said head and foot end portions of said lift frame and being pivotally mounted thereon about axes extending transversely of said horizontal bars; and (e) a pair of bed frame suspensions, one each of which is pivotally mounted upon said support bars at opposite end portions thereof for movement about an axis transverse thereof, said suspensions including means for connecting a bed frame thereto in supporting relation.

11. A body lift comprising:

(a) a mobile main frame having head and foot end portions;

(b) a lift frame carried by said main frame and being movable vertically relative thereto;

(c) controllable powered actuator mechanism carried by each of said end portions and connected to said lift frame for controllably raising and lowering the same as desired;

(d) said lift frame including (1) a generally inverted U-shaped frame having a head end portion carried by said actuator mechanism at the head end portion of said main frame and supported thereby; (2) a foot end portion carried by said actuator mechanism at the foot end portion of said main frame and supported thereby; (3) a pair of elongated transversely spaced, parallel, generally horizontal support bars each extending between head and foot end portions of said lift frame and being pivotally mounted thereon for movement about an axis transverse thereof; and (e) a pair of bed frame suspensions, one each of which is mounted upon said support bars at opposite end portions thereof, said suspensions including means for pivotally connecting a bed frame thereto in supporting relation.

12. A body lift comprising:

(a) a mobile main frame;

(b) a lift frame carried by said main frame and being movable vertically relative thereto;

(c) controllable power actuator mechanism carried by said main frame and connected to said lift frame in elevating and lowering relation;

(d) bed suspension means carried by said lift frame in supporting relation;

(e) bed frame means constructed and arranged to be quickly attached and detached to said bed suspension means;

(f) cooperative interlocking bed connector mechanism carried in supporting relation by said suspension means and by said bed frame means and releasably connecting said bed frame means to said suspension means;

(g) said connector mechanism including fixed connector elements carried by one of said means and shiftable interconnecting elements carried by the other of said means, said shiftable interconnecting elements being constructed and arranged to be quickly and easily shifted between locking and non-locking interengagement with said fixed connector elements to permit quick and easy ready attachment or detachment, as desired, of said bed frame means relative to said bed suspension means; and (h) said bed connector mechanism including a pair of sleeves mounted upon one of said means and said interconnecting elements including a pair of pins shiftably mounted on the other of said means and being shiftable axially of said sleeves into and out of telescoping relation thereto to provide such ready attachment and detachment of said bed means relative to said suspension means.

13. The structure defined in claim 12 wherein said shiftable pins are shifted by linkage pivotally mounted on said bed suspension means for pivotal movement about an axis extending longitudinally of said bed frame means.

14. The structure defined in claim 12 wherein said pins are interconnected and shifted by a link pivotably mounted for pivoting movement about an axis extending transversely of said suspension means.

15. The structure defined in claim 12, wherein said bed connector mechanism is pivotally mounted on said suspension means for pivotal movement thereof throughout a 360° arc and about an axis extending longitudinally of said bed frame means.

16. The structure defined in claim 15 and locking mechanism carried by said suspension means for engaging and locking said connector mechanism against further pivotal movement at a plurality of positions thereof relative to said suspension means.

17. The structure defined in claim 12 wherein said main frame and said lift frame are each longitudinally extensible and retractible.

18. The structure defined in claim 12 wherein said bed suspension means includes a U-shaped suspension bar pivotally connected at its upper ends to said lift frame at one end portion thereof, and a T-shaped suspension bar pivotally connected at the ends of its top cross-bar to said lift frame at the opposite end portion of the latter.

* * * * *

UNITED STATES PATENT AND TRADEMARK OFFICE

CERTIFICATE OF CORRECTION

PATENT NO. : 4,384,378

DATED : May 24, 1983

INVENTOR(S) : Clarence A. Getz and Clair A. Bearfield

It is certified that error appears in the above-identified patent and that said Letters Patent are hereby corrected as shown below:

Column 2, line 7, after "FIG." "1" should be --2--.

Signed and Sealed this

*Eighth* Day of *November 1983*

[SEAL]

*Attest:*

GERALD J. MOSSINGHOFF

*Attesting Officer*

*Commissioner of Patents and Trademarks*